US010566116B2

(12) United States Patent
Shatruk et al.

(10) Patent No.: US 10,566,116 B2
(45) Date of Patent: Feb. 18, 2020

(54) METHOD FOR TUNING THE FERROMAGNETIC ORDERING TEMPERATURE OF ALUMINUM IRON BORIDE

(71) Applicant: The Florida State University Research Foundation, Inc., Tallahassee, FL (US)

(72) Inventors: Michael Shatruk, Tallahassee, FL (US); Xiaoyan Tan, Tallahassee, FL (US); Ping Chai, Tallahassee, FL (US)

(73) Assignee: The Florida State University Research Foundation, Inc., Tallahassee, FL (US)

( * ) Notice: Subject to any disclaimer, the term of this patent is extended or adjusted under 35 U.S.C. 154(b) by 222 days.

(21) Appl. No.: 15/539,412

(22) PCT Filed: Jan. 8, 2016

(86) PCT No.: PCT/US2016/012635

§ 371 (c)(1),
(2) Date: Jun. 23, 2017

(87) PCT Pub. No.: WO2016/122856

PCT Pub. Date: Aug. 4, 2016

(65) Prior Publication Data

US 2018/0005736 A1 Jan. 4, 2018

Related U.S. Application Data

(60) Provisional application No. 62/109,374, filed on Jan. 29, 2015.

(51) Int. Cl.
*C22C 38/04* (2006.01)
*H01F 1/01* (2006.01)
(Continued)

(52) U.S. Cl.
CPC ..... *H01F 1/015* (2013.01); *C22C 33/0278* (2013.01); *C22C 33/04* (2013.01);
(Continued)

(58) Field of Classification Search
CPC ..... C22C 1/04; C22C 2202/02; C22C 33/04; C22C 38/04; C22C 38/06; C22C 38/32; H01F 1/015; H01F 1/147
(Continued)

(56) References Cited

U.S. PATENT DOCUMENTS 7,125,515 B2 * 10/2006 Aruga ..... C22C 1/026 420/528
2006/0137783 A1 6/2006 Aruga et al.

OTHER PUBLICATIONS

NPL-1: Jeischko,The crystal structure of Fe2AlB2, Acta Cryst. (1969), B25, pp. 163-165, (Year: 1969).*
(Continued)

*Primary Examiner* — Jie Yang
(74) *Attorney, Agent, or Firm* — Armstrong Teasdale LLP

(57) ABSTRACT

A series of solid solutions $AlFe_{2-x}MnxB_2$ have been synthesized by arc-melting and characterized by powder X-ray diffraction, and magnetic measurements. All the compounds adopt the parent $AlFe_2B_2$-type structure, in which infinite zigzag chains of B atoms are connected by Fe atoms into $[Fe_2B_2]$ slabs that alternate with layers of Al atoms along the b axis. The parent $AlFe_2B_2$ is a ferromagnet with $T_c$=282 K. A systematic investigation of solid solutions $AlFe_{2-x}Mn_x.B_2$ showed a non-linear change in the structural and magnetic behavior. The ferromagnetic ordering temperature is gradually decreased as the Mn content (x) increases. The substitution of Mn for Fe offers a convenient method for the adjustment of the ferromagnetic ordering temperature of $AlFe_2B_2$.

13 Claims, 4 Drawing Sheets

(51) Int. Cl.

| | |
|---|---|
| ***C22C 38/06*** | (2006.01) |
| ***C22C 33/04*** | (2006.01) |
| ***C22C 38/00*** | (2006.01) |
| ***C22C 33/02*** | (2006.01) |
| ***H01F 1/147*** | (2006.01) |

(52) U.S. Cl.
CPC ..... *C22C 38/002* (2013.01); *C22C 38/04* (2013.01); *C22C 38/06* (2013.01); *H01F 1/147* (2013.01); *C22C 2202/02* (2013.01)

(58) Field of Classification Search
USPC ..... 420/72
See application file for complete search history.

(56) References Cited

OTHER PUBLICATIONS

International Search Report and Written Opinion of the International Searching Authority regarding PCT/US2016/123635 dated Mar. 30, 2016; pp. 8.

Tan, Xiaoyan et al., Magnetocaloric Effect in AlFe2B2: Toward Magnetic Refrigerants from Earth-Abundant Elements, Journal of the American Chemical Society, 2013, vol. 135, pp. 9553-9557.

Chai, Ping et al., Investigation of magnetic properties and electronic structure of layered-structure borides A1TxBx (T=Fe, Mn, Cr) and AlFe2—xMnxB2, Journal of Solid State Chemistry, vol. 224, pp. 52-61, May 2014.

Du Qianheng, et al., Magnetic frustraction and magnetocaloric effect in AlFe2—xMnxB2 (x-0-0.5) ribbons, J. Phys. D: Applied Physics, vol. 48, 2015, pp. 1-6.

* cited by examiner

METHOD FOR TUNING THE FERROMAGNETIC ORDERING TEMPERATURE OF ALUMINUM IRON BORIDE

CROSS REFERENCE TO RELATED APPLICATION(S)

This application is a U.S. national stage application based on International Application No. PCT/US2016/012635, which was filed Jan. 8, 2016 and has published as International Publication No. WO 2016/122856. International Application No. PCT/US2016/012635 claims priority to U.S. Provisional Application Ser. No. 62/109,374, which was filed Jan. 29, 2015. Both priority applications are hereby incorporated by reference as if set forth in their entirety.

STATEMENT REGARDING FEDERALLY SPONSORED RESEARCH OR DEVELOPMENT

This invention was made with Government support under Grant No. DMR-0955353 awarded by the National Science Foundation. Part of this work was performed at the National High Magnetic Laboratory (NHMFL), which is supported by the NSF (DMR-1157490) and the State of Florida. The Government has certain rights in the invention.

FIELD OF THE INVENTION

The present invention relates to boride compounds, and more specifically to layered-structured borides of the general formula: $AlFe_{2-x}Mn_xB_2$.

BACKGROUND OF THE INVENTION

Transition metal borides have found a number of technologically important applications, among which the most notable is their use as permanent magnets based on neodymium iron boride, $Nd_2Fe_{14}B$. See J. F. Herbst, Rev. Mod. Phys., 63 (1991) 819-898. The research on the magnetism of complex intermetallic borides thus has been predominantly focused on the rare-earth containing systems with strong magnetic anisotropy. The latter, when combined with the high saturation magnetization of the transition metal sublattice, offers the highest energy products and thus the strongest permanent magnets known. See O. Gutfleisch, M. A. Willard, E. Bruck, C. H. Chen, S. G. Sankar, J. P. Liu, Adv. Mater., 23 (2011) 821-842. In contrast, the magnetism of rare-earth free borides is far less explored. Such materials usually behave as soft magnets, which could be one of the reasons why their magnetic behavior has not inspired as much research interest as the properties of the rare-earth containing borides. Nevertheless, two recent thrusts poise rare-earth free magnetic materials to gain increased attention. The first is the need to discover novel permanent magnets with decreased rare-earth content. See Critical Materials Strategy, U.S. Department of Energy, Washington, D.C., 2010. The second direction is due to the discovery of giant magnetocaloric effect at room temperature that promises to become the foundation of the future refrigeration technology. See K. A. Gschneidner, Jr., V. K. Pecharsky, A. O. Tsokol, Rep. Prog. Phys., 68 (2005) 1479-1539; B. G. Shen, J. R. Sun, F. X. Hu, H. W. Zhang, Z. H. Cheng, Adv. Mater., 21 (2009) 4545-4564; and V. Franco, J. S. Blazquez, B. Ingale, A. Conde, Annu. Rev. Mater. Res., 42 (2012) 305-342. The latter requires the use of soft magnets with high saturation magnetization to achieve a large cooling effect while avoiding hysteretic energy losses in a quickly alternating magnetic field.

We have recently reported the promising magnetocaloric properties of $AlFe_2B_2$, a ternary boride with a rather simple layered structure, the magnetic behavior of which went overlooked for more than 40 years. See X. Y. Tan, P. Chai, C. M. Thompson, M. Shatruk, J. Am. Chem. Soc., 135 (2013) 9553-9557 and W. Jeitschko, Acta Crystallogr. Sect. B, 25 (1969) 163-165. Our initial interest in this material was sparked by the high saturation magnetization offered by FeB. The ordering temperature of this ferromagnet, however, is too high for practical purposes (around 600 K). Consequently, we turned to the ternary material that affords a "diluted" magnetic lattice featuring two-dimensional (2-D) $[Fe_2B_2]$ slabs alternating with layers of Al atoms along the b axis of the orthorhombic unit cell. See FIG. 1, which is a depiction of the crystal structures of $AlFe_2B_2$. The $[Fe_2B_2]$ slabs are highlighted (Fe=larger atoms and B=smaller atoms in the highlighted slabs). Al atoms are located between the $[Fe_2B_2]$ slabs. $AlFe_2B_2$ shows ferromagnetic ordering at ~300 K nearly zero coercivity, and a significant magnetocaloric effect. Another attractive feature of this material is its being composed of earth-abundant, lightweight elements.

SUMMARY OF THE INVENTION

Briefly, the present invention is directed to a solid solution having the general formula: $AlFe_{2-x}Mn_xB_2$, wherein x is at least 0.1.

The present invention is further directed to a series of solid solutions having the general formula: $AlFe_{2-x}Mn_xB_2$.

Other objects and features will be in part apparent and in part pointed out hereinafter.

DESCRIPTION OF THE EMBODIMENT(S) OF THE INVENTION

The present invention is directed to a series of solid solutions having the general formula: $AlFe_{2-x}Mn_xB_2$. Herein, x has a value between 0 and 2, such as between 0.1 and 2, or between 0.1 and 1.9. In some embodiments, x can have a nominal value of any of 0, 0.4, 0.65, 0.8, 1.0, 1.2, 1.6, and 2.0. The value of x may vary from these nominal values by +/−0.06, preferably by no more than +/−0.03. Accordingly, a nominal value of 0.4, for example, may encompass an x value between 0.34 and 0.46, preferably between 0.37 and 0.43. A nominal value of 0.65 may encompass an x value between 0.59 and 0.71, preferably between 0.62 and 0.68. A nominal value of 0.8 may encompass an x value between 0.74 and 0.86, preferably between 0.77 and 0.83. A nominal value of 1.0 may encompass an x value between 0.94 and 1.06, preferably between 0.97 and 1.03. A nominal value of 1.2 may encompass an x value between 1.14 and 1.26, preferably between 1.17 and 1.23. A nominal value of 1.6 may encompass an x value between 1.54 and 1.66, preferably between 1.57 and 1.63.

The present invention is further directed to a solid solution having the general formula: $AlFe_{2-x}Mn_xB_2$, wherein x has a value between 0 and 2. In some embodiments, x is at least 0.1. In some embodiments, x is between 0.1 and 2. In some embodiments, x is between 0.1 and 1.9. In some embodiments, x is between 0.1 and 0.3. In some embodiments, x is between 0.3 and 0.5. In some embodiments, x is between 0.5 and 0.7. In some embodiments, x is between 0.7 and 0.9. In some embodiments, x is between 0.9 and 1.1. In some embodiments, x is between 1.1 and 1.3. In some embodiments, x is between 1.3 and 1.5. In some embodiments, x is between 1.5 and 1.7. In some embodiments, x is between 1.7 and 1.9. In some embodiments, x is between 1.9 and 2.0.

The present invention reports a detailed study of solid solutions having the general formula $AlFe_{2-x}Mn_xB_2$. Herein, x has a value between 0 and 2, such as between 0.1 and 2, or between 0.1 and 1.9. We demonstrate the change in the magnetic behavior upon substitution of Mn for Fe.

Results and Discussion

Synthesis and Crystal Structure

Figure 1:
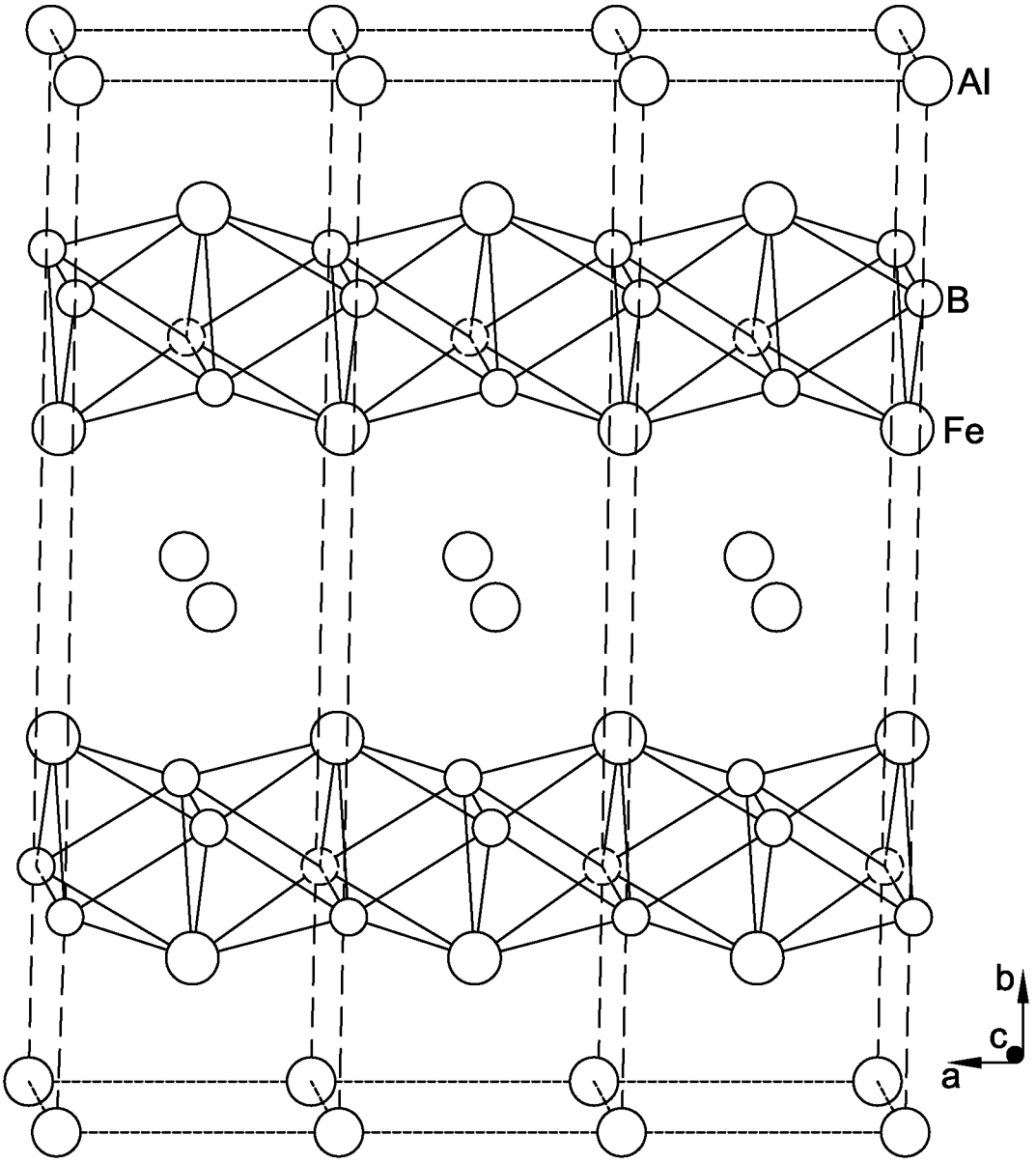
FIG. 1 is a depiction of the crystal structures of $AlFe_2B_2$. The $[Fe_2B_2]$ slabs are highlighted (Fe=larger atoms and B=smaller atoms in the highlighted slabs). Al atoms are located between the $[Fe_2B_2]$ slabs.
Figure 2:
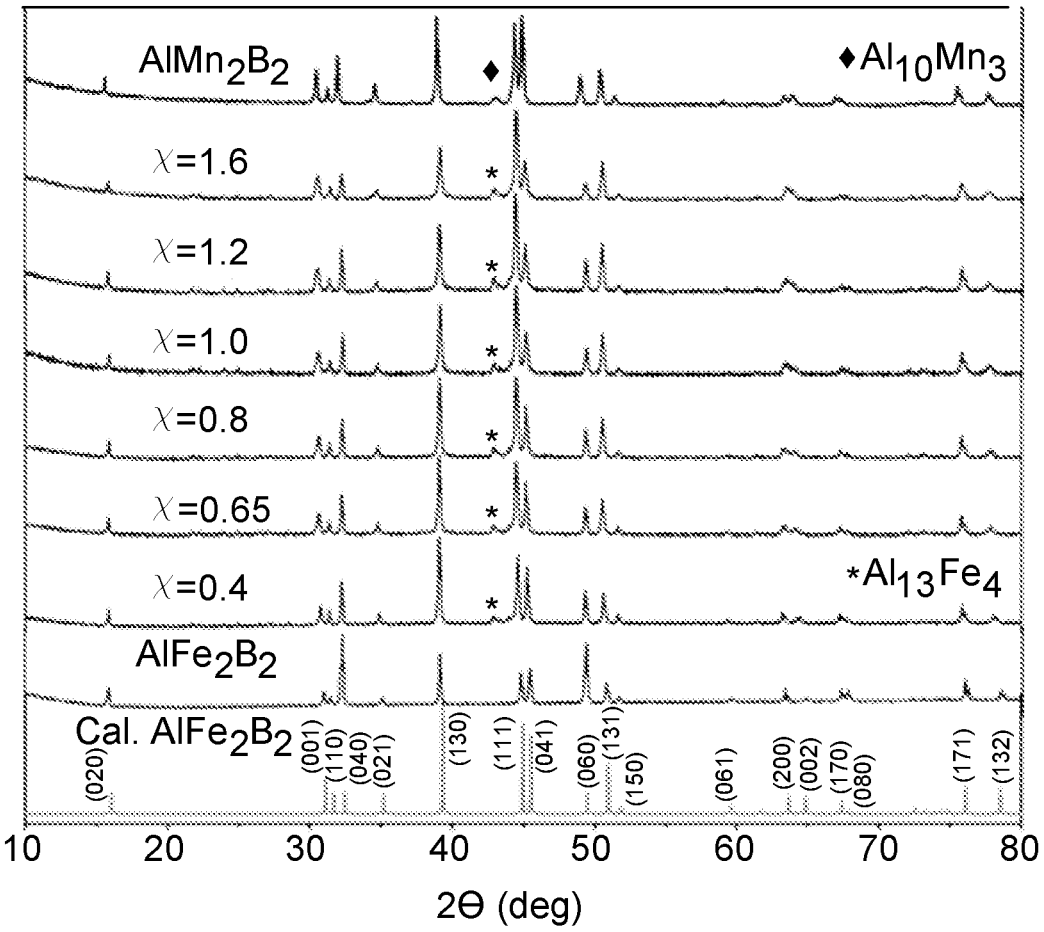
FIG. 2 is X-ray powder diffraction patterns of $AlFe_{2-x}Mn_xB_2$. The bottom, light-gray pattern was calculated based on the reported crystal structure of $AlFe_2B_2$. See W. Jeitschko, Acta Crystallogr. Sect. B, 25 (1969) 163-165. In the powder diffraction patterns, the asterisk (*) and rhombus (♦) marks indicate the $Al_{13}Fe_4$ and $Al_{10}Mn_3$ impurities, respectively.

A series of solid solutions $AlFe_{2-x}Mn_xB_2$ (x=0, 0.4, 0.65, 0.8, 1.0, 1.2, 1.6), were prepared by arc-melting. All of them crystallize in the $AlFe_2B_2$ structure type, as shown by the comparison of the experimental and calculated powder X-ray diffraction patterns. See FIG. 2, which are X-ray powder diffraction patterns of $AlFe_{2-x}Mn_xB_2$. The bottom, light-gray pattern was calculated based on the reported crystal structure of $AlFe_2B_2$. See W. Jeitschko, Acta Crystallogr. Sect. B, 25 (1969) 163-165. In the powder diffraction patterns, the asterisk (*) and rhombus (♦) marks indicate the $Al_{13}Fe_4$ and $Al_{10}Mn_3$ impurities, respectively. $AlFe_2B_2$ was obtained in phase-pure form after treatment of the reaction products with dilute HCl. Such work up, however, was not possible for Mn-containing phases that turned out to be much more acid-sensitive than $AlFe_2B_2$. For that reason, the samples of $AlFe_{2-x}Mn_xB_2$ and $AlMn_2B_2$ were contaminated with small amounts of $Al_{13}Fe_4$ and $Al_{10}Mn_3$, respectively.

Figure 3:
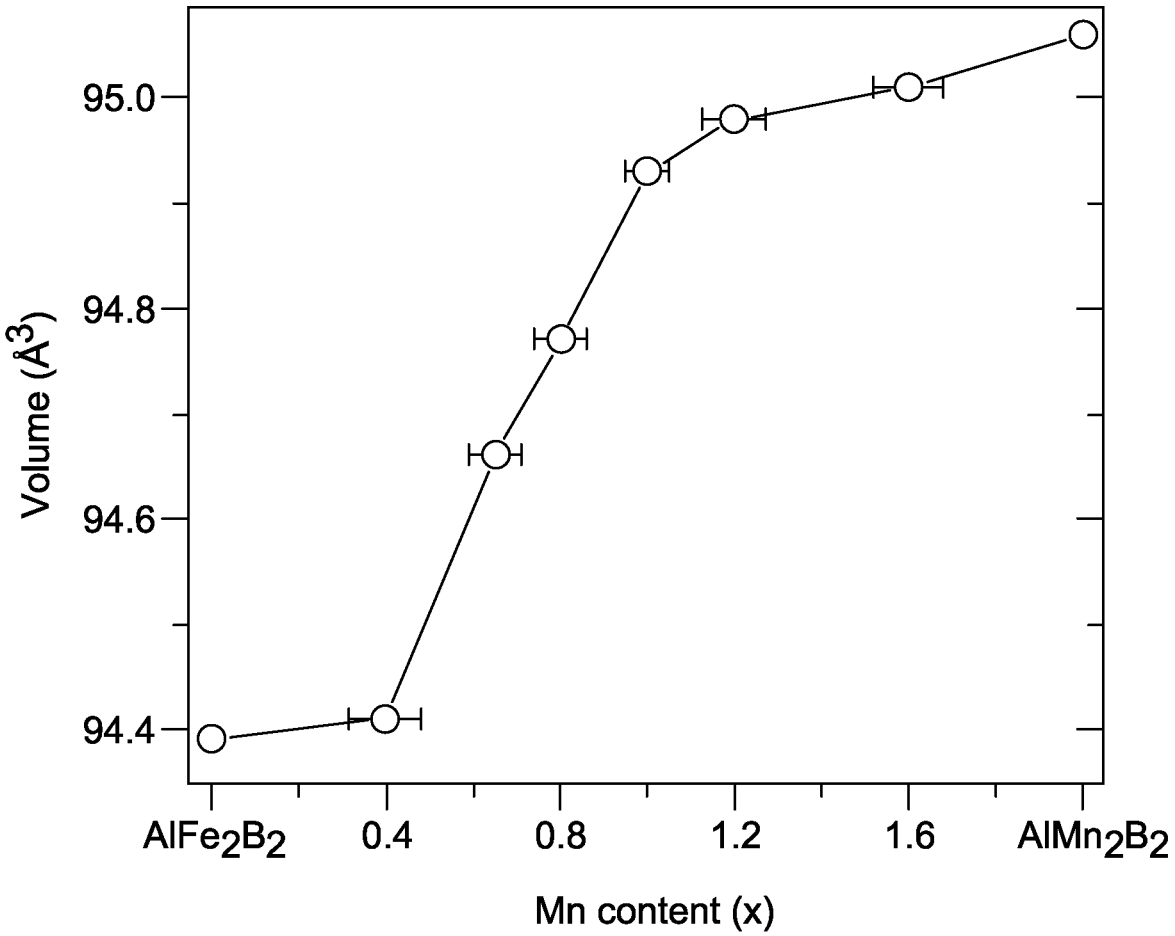
FIG. 3 depicts the Unit cell volume of $AlFe_{2-x}Mn_xB_2$ as a function of x. The standard deviations for the volume are smaller than the symbol size.

The refinements of PXRD data revealed that substitution of Mn for Fe in $AlFe_2B_2$ leads to the increase in the unit cell volume, in accord with the larger size of Mn atoms. See FIG. 3, which depicts the unit cell volume of $AlFe_{2-x}Mn_xB_2$ as a function of x. The standard deviations for the volume are smaller than the symbol size. See also Table 1. The unit cell parameters and unit cell volume change non-linearly with the Mn content (x). As will be shown below, this irregularity is also reflected in the magnetic behavior of $AlFe_{2-x}Mn_xB_2$.

TABLE 1

EDX analysis compositions, unit cell parameters, magnetic ordering temperatures ($T_C$), and saturation magnetization at 1.8 K ($M_{sat}$) for $AlFe_{2-x}Mn_xB_2$.

| Sample | Mn content from EDX analysis (x) | a, Å | b, Å | c, Å | V, Å$^3$ | $T_C$, K | $M_{sat}$, $\mu_B$ per T atom |
|---|---|---|---|---|---|---|---|
| $AlFe_2B_2$ | — | 2.945 (4) | 11.09 (1) | 2.887 (3) | 94.39 (1) | 282 | 1.15 |
| $AlFe_{1.6}Mn_{0.4}B_2$ | 0.37 (8) | 2.941 (3) | 11.08 (1) | 2.895 (3) | 94.38 (1) | 242 | 0.87 |
| $AlFe_{1.35}Mn_{0.65}B_2$ | 0.63 (6) | 2.913 (9) | 11.07 (4) | 2.936 (9) | 94.66 (1) | 220 | 0.60 |
| $AlFe_{1.2}Mn_{0.8}B_2$ | 0.74 (6) | 2.912 (8) | 11.09 (4) | 2.936 (8) | 94.77 (1) | 188 | 0.50 |
| $AlFeMnB_2$ | 0.95 (5) | 2.938 (2) | 11.07 (1) | 2.919 (4) | 94.93 (1) | 119 | 0.38 |
| $AlFe_{0.8}Mn_{1.2}B_2$ | 1.22 (7) | 2.942 (9) | 11.05 (2) | 2.921 (8) | 94.98 (1) | 43 | 0.16 |
| $AlFe_{0.4}Mn_{1.6}B_2$ | 1.57 (8) | 2.937 (5) | 11.08 (1) | 2.921 (4) | 95.01 (1) | — | 0.07 |
| $AlMn_2B_2$ | — | 2.936 (5) | 11.12 (1) | 2.912 (8) | 95.06 (1) | — | — |

A detailed description of the crystal structure of $AlFe_2B_2$ can be found in our recent paper. See X. Y. Tan, P. Chai, C. M. Thompson, M. Shatruk, J. Am. Chem. Soc., 135 (2013) 9553-9557. All $AlFe_{2-x}Mn_xB_2$ embodiments are isostructural to $AlFe_2B_2$. All these structures contain 2-D $[T_2B_2]$ slabs alternating with layers of Al atoms along the b axis. T in the formulation may be either of Fe, Mn, or a combination of Fe and Mn (i.e., $Fe_{2-x}Mn_x$ wherein x has a value between 0 and 2). The B atoms form a layer of zigzag chains inside the slabs that are capped above and below by T atoms. Thus, the structure has a distinct 2-D topology, especially in the sense of magnetic exchange interactions between the T sites. Noteworthy, similar zigzag chains of B atoms are found in the structures of binary transition-metal borides, TB, where the transition metal atoms bind the boron chains into an extended 3-D framework. Therefore, the structure of $AlT_2B_2$ can be viewed as generated from the binary structure by the introduction of Al atoms, which break down the 3-D framework of the binary boride to create the corresponding layered structure of the ternary boride.

Magnetic Properties

Figure 4A:
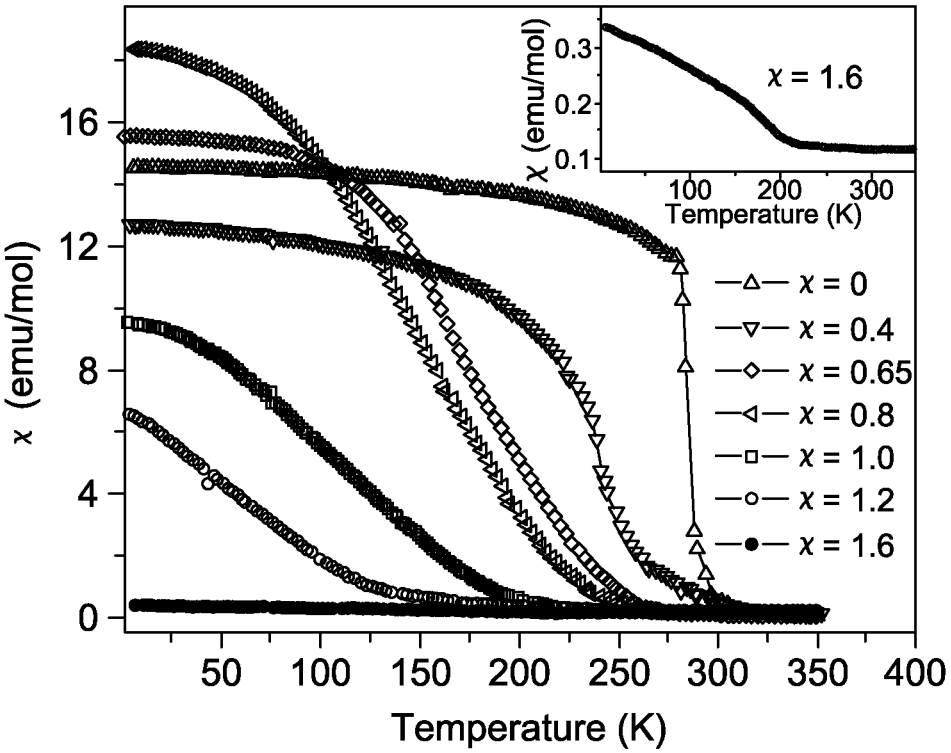
FIG. 4A depicts the temperature dependence of magnetic susceptibility for $AlFe_{2-x}Mn_xB_2$ measured under applied magnetic field of 1 mT; the dependence for x=1.6 is shown as the inset.
Figure 4B:
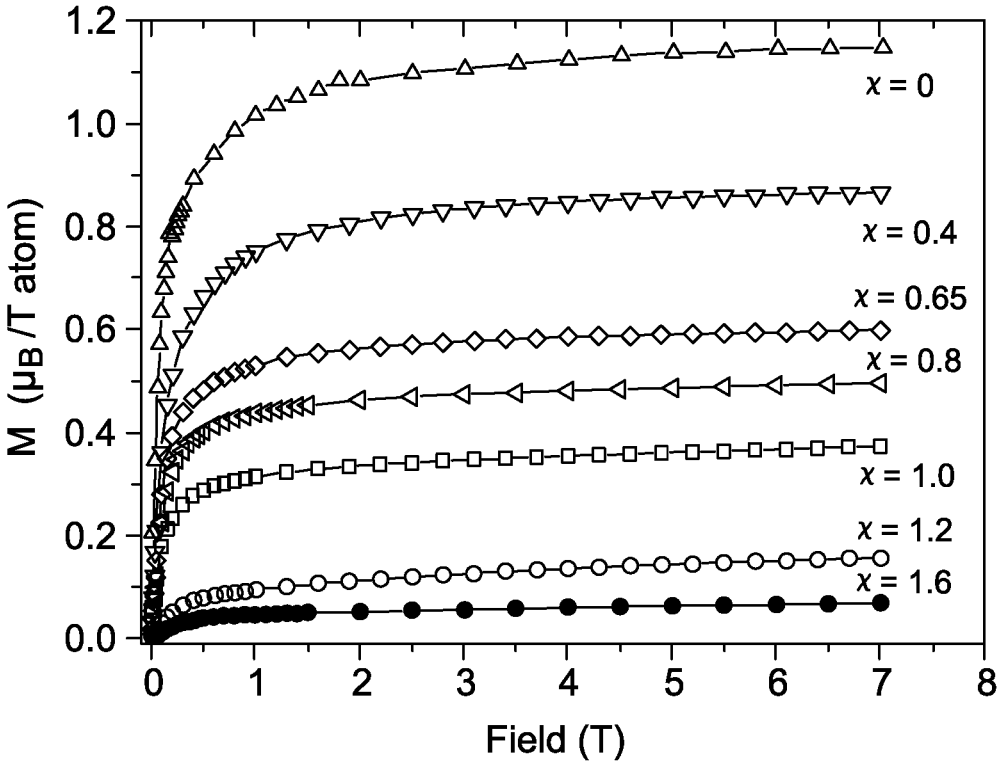
FIG. 4B depicts the Field dependent magnetization of $AlFe_{2-x}Mn_xB_2$ measured at 1.8

In agreement with the earlier reports, $AlFe_2B_2$ exhibits an abrupt increase in the magnetic moment associated with the ferromagnetic phase transition at $T_C$=282 K See X. Y. Tan, P. Chai, C. M. Thompson, M. Shatruk, J. Am. Chem. Soc., 135 (2013) 9553-9557 and M. El Massalami, D.d. Oliveira, H. Takeya, J. Magn. Magn. Mater., 323 (2011) 2133-2136. The substitution of Mn for Fe gradually suppresses the ferromagnetic behavior (See FIG. 4A), as the magnetic phase transition for the $AlFe_{2-x}Mn_xB_2$ samples becomes less abrupt with the increase in the Mn content (x) and the 1.8-K saturation magnetization per T atom also gradually decreases (See FIG. 4B), dropping from 1.15 $\mu_B$ for x=0 to only 0.07 $\mu_B$ for x=1.6 (Table 1). FIG. 4A is a graph depicting the temperature dependence of magnetic susceptibility for $AlFe_{2-x}Mn_xB_2$ measured under applied magnetic field of 1 mT; the dependence for x=1.6 is shown as the inset. FIG. 4B is a graph depicting field dependent magnetization of $AlFe_{2-x}Mn_xB_2$ measured at 1.8 K.

Conclusions

The series of solid solutions $AlFe_{2-x}Mn_xB_2$, whose structure contains 2-D $[Fe_{2-x}Mn_xB_2]$ slabs alternating with layers of Al atoms, exhibits gradual evolution of magnetic properties with the change in the d-electron count. The itinerant ferromagnetism in the $AlFe_{2-x}Mn_xB_2$ series becomes most pronounced in $AlFe_2B_2$, which exhibits ferromagnetic ordering at 282 K The latter was shown by us to be a promising magnetic refrigerant, and thus the present invention provides a convenient method for varying the magnetic ordering temperature thereof.

EXAMPLES

The following non-limiting examples are provided to further illustrate the present invention.

Materials and Methods

Synthesis

All manipulations during sample preparation were carried out in an argon-filled dry box (content of $O_2$<1 ppm). Powders of aluminum (99.95%), manganese (99.95%), and iron (98%) were obtained from Alfa Aesar. Boron powder (95-97%) was obtained from Strem Chemicals. Mn and Fe metals were additionally purified by heating in a flow of $H_2$ gas for 5 h at 775 K Fused-silica tubes were obtained from National Scientific Corporation, Inc. (Quakertown, Pa.). Phase-pure $AlFe_2B_2$ was prepared by arc-melting a mixture of elements followed by annealing and post-treatment with dilute HCl, as previously reported. See X. Y. Tan, P. Chai, C. M. Thompson, M. Shatruk, J. Am. Chem. Soc., 135 (2013) 9553-9557. The samples $AlFe_{2-x}Mn_xB_2$ (x=0.4, 0.65, 0.8, 1.0, 1.2, 1.6, 2.0) were synthesized by arc-melting mixtures of elements that were weighed out in the ratio of Al:Fe:Mn:B=1.5:(2-x):x:2 and pressed into pellets. (The 50 wt. % excess of Al was found to minimize the content of byproducts.) The ingots obtained after arc-melting were sealed under vacuum (<$10^{-2}$ mbar) in 10 mm inner diameter (i.d.) silica tubes and annealed at 1073 K for one week. The powder patterns at this point revealed the major target phase contaminated with small amounts of $Al_{13}Fe_4$ and MnB. Thus, the ingots were ground, pelletized, sealed under vacuum in 10 mm i.d. silica tubes, and re-annealed at 1073 K for another week. The obtained samples contained the desired product with a trace amount of $Al_{13}Fe_4$. The removal of this byproduct by treatment with dilute HCl, however, was impossible, because $AlMn_2B_2$ reacted with acid swiftly.

Since all bulk samples of $AlMn_2B_2$ were contaminated with a trace amount of $Al_{10}Mn_3$, single crystals of $AlMn_2B_2$ were also grown from Al flux for magnetic property measurements. The starting materials with the Al:Mn:B ratio of 10:1:2 were mixed and placed into a 10 mm i.d. alumina crucible, covered with a piece of silica wool, and sealed into a 13 mm i.d. silica tube under vacuum (<$10^{-2}$ mbar). The reaction was heated up to 1423 K in 15 h, held at that temperature for 15 h, and then slowly cooled down at 1 K/min. After reaching 1273 K the tube was quickly taken out of the furnace, flipped upside down, and placed into a centrifuge for hot filtration through the silica wool to remove the unreacted liquid Al. The obtained sample contained plate-shaped crystals of $AlMn_2B_2$ (maximum size ~0.4×0.2×0.02 $mm^3$), as well as small amounts of byproducts, $AlB_2$ and $Al_{57}Mn_{12}$, and traces of Al. The crystals of $AlMn_2B_2$ could be easily distinguished upon visual inspection of the sample and were picked up manually for further measurements.

X-ray Diffraction

Room temperature powder X-ray diffraction (PXRD) was carried out on a PANalytical X'Pert Pro diffractometer with an X'Celerator detector using Cu-Kα radiation (λ=1.54187 Å). To avoid the fluorescence of Fe-containing samples, a graphite monochromator was used on the secondary side of the powder diffraction system. The corresponding statement has been added to the text. The patterns were recorded in the 2θ range of 10° to 80° with a step of 0.017° and the total collection time of one hour. The analysis of PXRD patterns was carried out with the HighScore Plus suite. Highscore Plus, PANalytical B.V., Almelo, Netherlands, 2006. The identity of $AlMn_2B_2$ single crystals was verified by room-temperature unit cell determination on a Bruker AXS SMART diffractometer equipped with an APEX-II CCD detector and Mo-Kα X-ray source (λ=0.71093 Å).

Physical Measurements

The elemental analyses were performed on a JEOL 5900 scanning electron microscope equipped with energy dispersive X-ray (EDX) spectrometer. Multiple locations on different crystallites were probed to establish the statistically averaged composition of each sample. The elemental ratios established for each sample agreed well with the nominal composition used for the sample preparation. Magnetic measurements were performed with a Quantum Design SQUID magnetometer MPMS-XL. Direct current (DC) magnetic susceptibility measurements were carried out in the field-cooled (FC) mode in the 1.8-300 K temperature range. Additional DC susceptibility measurements were performed on samples with x=1.2 and 1.6 in the zero-field-cooled (ZFC) and FC modes from 320 to 750 K Isothermal field-dependent magnetization was measured at 1.8 K with the field varying from 0 to 7 T.

When introducing elements of the present invention or the preferred embodiments(s) thereof, the articles "a", "an", "the" and "said" are intended to mean that there are one or more of the elements. The terms "comprising", "including" and "having" are intended to be inclusive and mean that there may be additional elements other than the listed elements.

In view of the above, it will be seen that the several objects of the invention are achieved and other advantageous results attained.

As various changes could be made in the above compositions and processes without departing from the scope of the invention, it is intended that all matter contained in the above description and shown in the accompanying drawings shall be interpreted as illustrative and not in a limiting sense.

What is claimed is:

1. A series of solid solutions having the general formula: $AlFe_{2-x}Mn_xB_2$, wherein x has a value between 0.1 and 1.9.

2. The series of claim 1 wherein x has a value selected from the group consisting of 0.4, 0.65, 0.8, 1.0, 1.2, 1.6, and any combination thereof, wherein the value of x may vary by +/−0.06.

3. A solid solution having the general formula: $AlFe_{2-x}Mn_xB_2$, wherein x is between 0.1 and 1.9.

4. The solid solution of claim 3 comprising Fe-rich phases and Mn-rich phases.

5. The solid solution of claim 3 wherein x is between 0.1 and 0.3.

6. The solid solution of claim 3 wherein x is between 0.3 and 0.5.

7. The solid solution of claim 3 wherein x is between 0.5 and 0.7.

8. The solid solution of claim 3 wherein x is between 0.7 and 0.9.

9. The solid solution of claim 3 wherein x is between 0.9 and 1.1.

10. The solid solution of claim 3 wherein x is between 1.1 and 1.3.

11. The solid solution of claim 3 wherein x is between 1.3 and 1.5.

12. The solid solution of claim 3 wherein x is between 1.5 and 1.7.

13. The solid solution of claim 3 wherein x is between 1.7 and 1.9.

* * * * *